US010661578B2

(12) United States Patent
Kodera et al.

(10) Patent No.: US 10,661,578 B2
(45) Date of Patent: May 26, 2020

(54) PRINTING APPARATUS AND CONCENTRATION CORRECTION METHOD

(71) Applicant: CANON KABUSHIKI KAISHA, Tokyo (JP)

(72) Inventors: Yasuto Kodera, Fujisawa (JP); Hiroshi Netsu, Yokohama (JP); Yasuyuki Tamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/218,813

(22) Filed: Dec. 13, 2018

(65) Prior Publication Data

US 2019/0224984 A1 Jul. 25, 2019

(30) Foreign Application Priority Data

Jan. 25, 2018 (JP) ..... 2018-010511

(51) Int. Cl.

| | |
|---|---|
| ***B41J 2/195*** | (2006.01) |
| ***B41J 2/14*** | (2006.01) |
| ***B41J 29/38*** | (2006.01) |
| ***B41J 2/18*** | (2006.01) |
| ***B41J 2/045*** | (2006.01) |
| ***B41J 2/165*** | (2006.01) |
| ***B41J 2/17*** | (2006.01) |
| ***B41J 2/21*** | (2006.01) |

(52) U.S. Cl.

CPC ..... *B41J 2/195* (2013.01); *B41J 2/04571* (2013.01); *B41J 2/14233* (2013.01); *B41J 2/165* (2013.01); *B41J 2/1707* (2013.01); *B41J 2/18* (2013.01); *B41J 2/211* (2013.01); *B41J 29/38* (2013.01); *B41J 2/0458* (2013.01); *B41J 2202/12* (2013.01); *B41J 2202/21* (2013.01)

(58) Field of Classification Search

CPC . B41J 2/195; B41J 2/211; B41J 2/1707; B41J 2/165; B41J 2/04571; B41J 2/18; B41J 2202/12

See application file for complete search history.

(56) References Cited

U.S. PATENT DOCUMENTS

| | | | | |
|---|---|---|---|---|
| 5,424,766 | A | 6/1995 | Anderson | |
| 7,182,420 | B2 | 2/2007 | Nakazawa | |
| 2011/0069118 | A1* | 3/2011 | Ohzeki | B41J 2/14233 347/44 |

FOREIGN PATENT DOCUMENTS

| | | | |
|---|---|---|---|
| JP | 09-504756 | A | 5/1997 |
| JP | 2005-153454 | A | 6/2005 |

* cited by examiner

*Primary Examiner* — Julian D Huffman
(74) *Attorney, Agent, or Firm* — Venable LLP

(57) ABSTRACT

A printing apparatus which includes a circulation route configured to supply ink stored in a storage unit to a print head via a supply passage and send back the ink collected from the print head to the storage unit via a collection passage and which performs printing on a print medium by ejecting the ink from the print head includes: a first detection unit which detects an ink concentration in the collection passage; an injection unit which injects a correcting liquid capable of correcting the ink concentration into a circulated ink flow downstream of a position where the first detection unit detects the concentration in the collection passage; and a control unit which obtains an injection amount of the correcting liquid based on the concentration detected by the first detection unit and controls the injection unit such that the correcting liquid is injected in the injection amount.

12 Claims, 12 Drawing Sheets

$f = V/\lambda = V/L \qquad \lambda = L$ $V \propto$ INK CONCENTRATION

V:SPEED OF SOUND IN INK

L :LENGTH OF RESONANCE TUBE 46

$\lambda$ :WAVELENGTH OF SOUND f :RESONANCE FREQUENCY

| FIG.10A | FIG.10B |
|---|---|

PRINTING APPARATUS AND CONCENTRATION CORRECTION METHOD

BACKGROUND OF THE INVENTION

Field of the Invention

The present invention relates to a printing apparatus configured to perform printing by ejecting ink to a print medium and to a concentration correction method of correcting a concentration of the ink to be ejected in the printing apparatus.

Description of the Related Art

In order for an inkjet printing apparatus to allow ink to continuously exhibit predetermined favorable characteristics in printing such as an ejection performance, there is known a technique in which the ink is circulated via a print head and the concentration of the circulated ink is corrected when the concentration of the ink changes. For example, Japanese Patent Laid-Open No. 2005-153454 discloses a technique in which an adjustment ink is supplied to an ink tank provided in a circulation route based on a detection result of a detection unit configured to detect the ink concentration. Moreover, Published Japanese Patent Laid-Open No. H9-504756(1997) discloses a technique in which the ink concentration is corrected in one of reservoirs in a circulation route based on a detection result of the ink concentration and the ink subjected to the concentration correction in the one reservoir is supplied to the other reservoir connected to a print head.

However, in the technique disclosed in Japanese Patent Laid-Open No. 2005-153454, there is used a configuration in which the ink requiring concentration correction is mixed with the adjustment ink in the ink tank storing the ink. Accordingly, it takes long time for the ink concentration to become uniform. Thus, the ink requiring concentration correction is supplied to the print head until the ink concentration becomes uniform, and print quality may decrease. In order to solve such a problem, for example, it is conceivable to provide multiple configurations for storing the ink as in Published Japanese Patent Laid-Open No. H9-504756 (1997). However, Published Japanese Patent Laid-Open No. H9-504756(1997) has another problem that the ink cannot be supplied from the one reservoir to the other reservoir until the ink concentration is corrected and becomes uniform in the one reservoir, and a print operation may need to be suspended.

SUMMARY OF THE INVENTION

An object of the present invention is to provide a printing apparatus and a concertation correction method which can suppress a decrease in print quality without suspending a print operation.

In the first aspect of the present invention, there is provided a printing apparatus which includes a circulation route configured to supply ink stored in a storage unit to a print head via a supply passage and send back the ink collected from the print head to the storage unit via a collection passage and which performs printing on a print medium by ejecting the ink from the print head, comprising: a first detection unit configured to detect a concentration of the ink in the collection passage; an injection unit configured to inject a correcting liquid capable of correcting the concentration of the ink into a circulated ink flow downstream of a position where the first detection unit detects the concentration in the collection passage; and a control unit configured to obtain an injection amount of the correcting liquid based on the concentration detected by the first detection unit and control the injection unit such that the correcting liquid is injected in the obtained injection amount.

In the second aspect of the present invention, there is provided a concentration correction method of correcting a concentration of ink in a circulation route configured to supply the ink stored in a storage unit to a print head via a supply passage and send back the ink collected from the print head to the storage unit via a collection passage, comprising: a first detection step of detecting the concentration of the ink in the collection passage; and an injection step of obtaining an injection amount of a correcting liquid capable of correcting the concentration of the ink based on the concentration detected in the first detection step and injecting the correcting liquid in the obtained injection amount into a circulated ink flow downstream of a position where the concentration is detected in the first detection step in the collection passage.

According to the present invention, the concentration of the ink can be corrected without suspending the ejection operation.

Further features of the present invention will become apparent from the following description of exemplary embodiments with reference to the attached drawings.

DESCRIPTION OF THE EMBODIMENTS

Examples of a printing apparatus and a concentration correction method according to the present invention are described below in detail with reference to the attached drawings. Note that elements described in the following embodiments are merely examples and the scope of the present invention is not intended to be limited to the described elements.

First Embodiment

Figure 1:
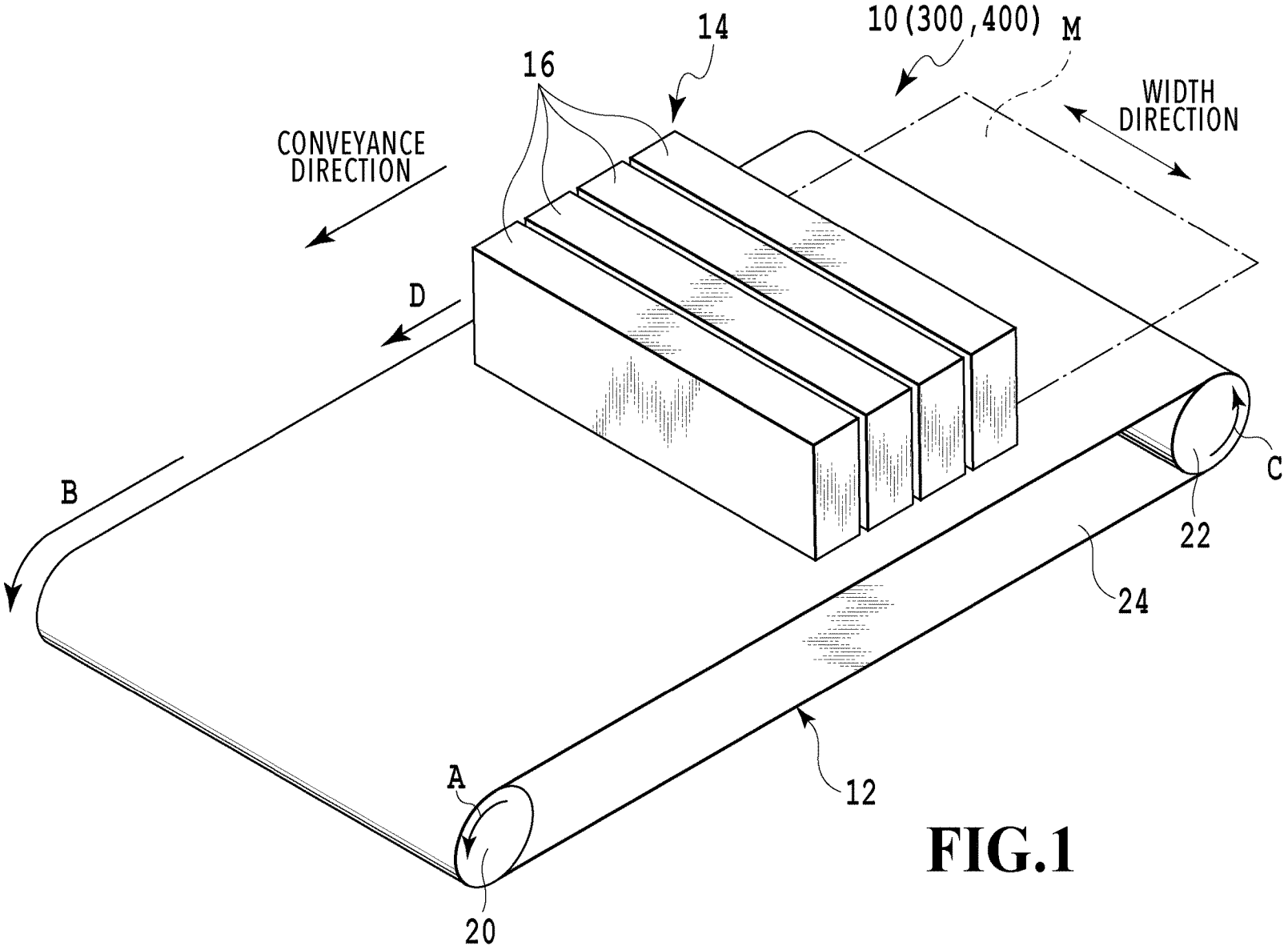
FIG. 1 is a schematic configuration view of a main portion of a printing apparatus according to the present invention.
Figure 2:
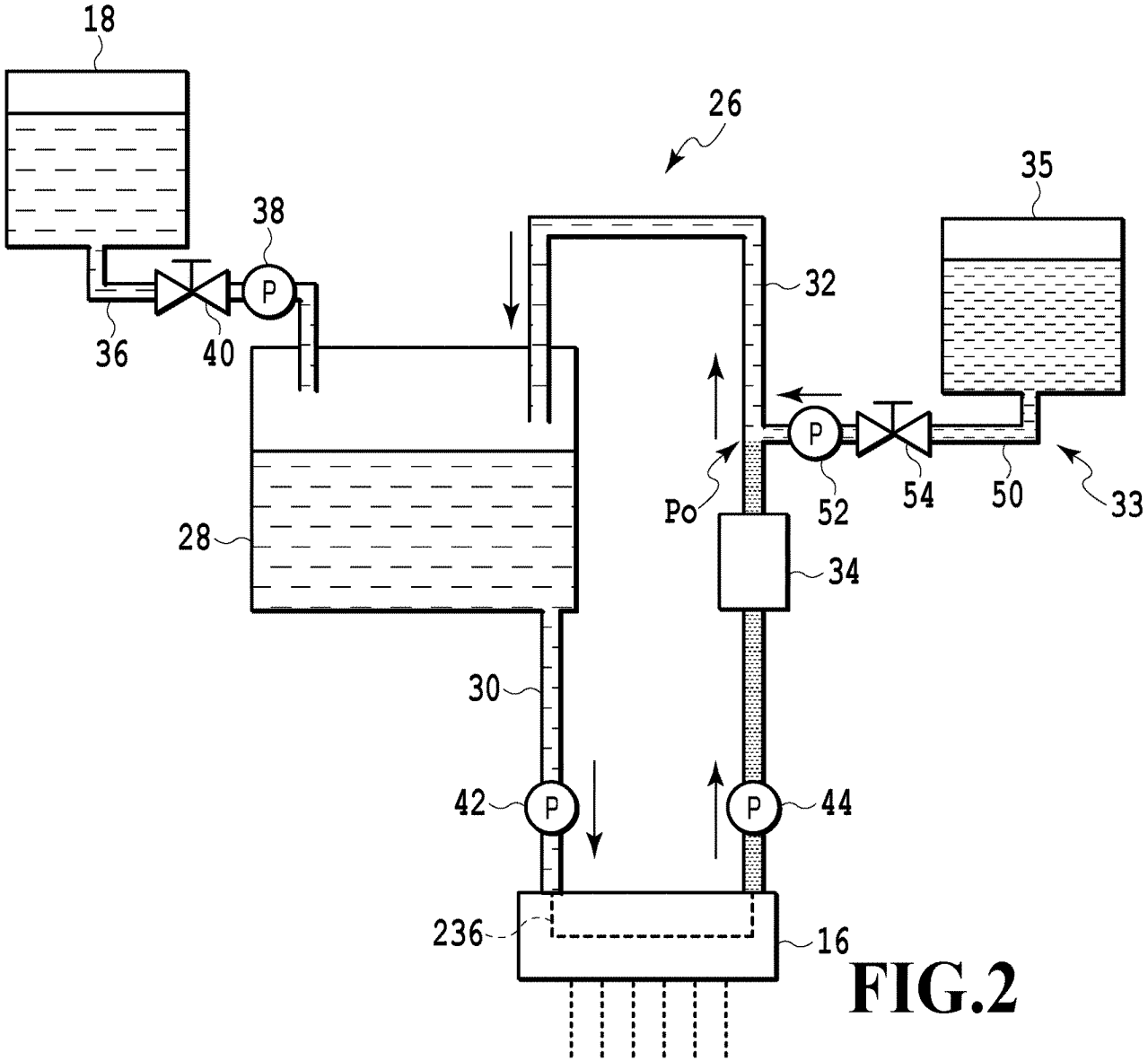
FIG. 2 is a schematic configuration view of an ink supply system in the printing apparatus according to a first embodiment of the present invention.
Figure 3:
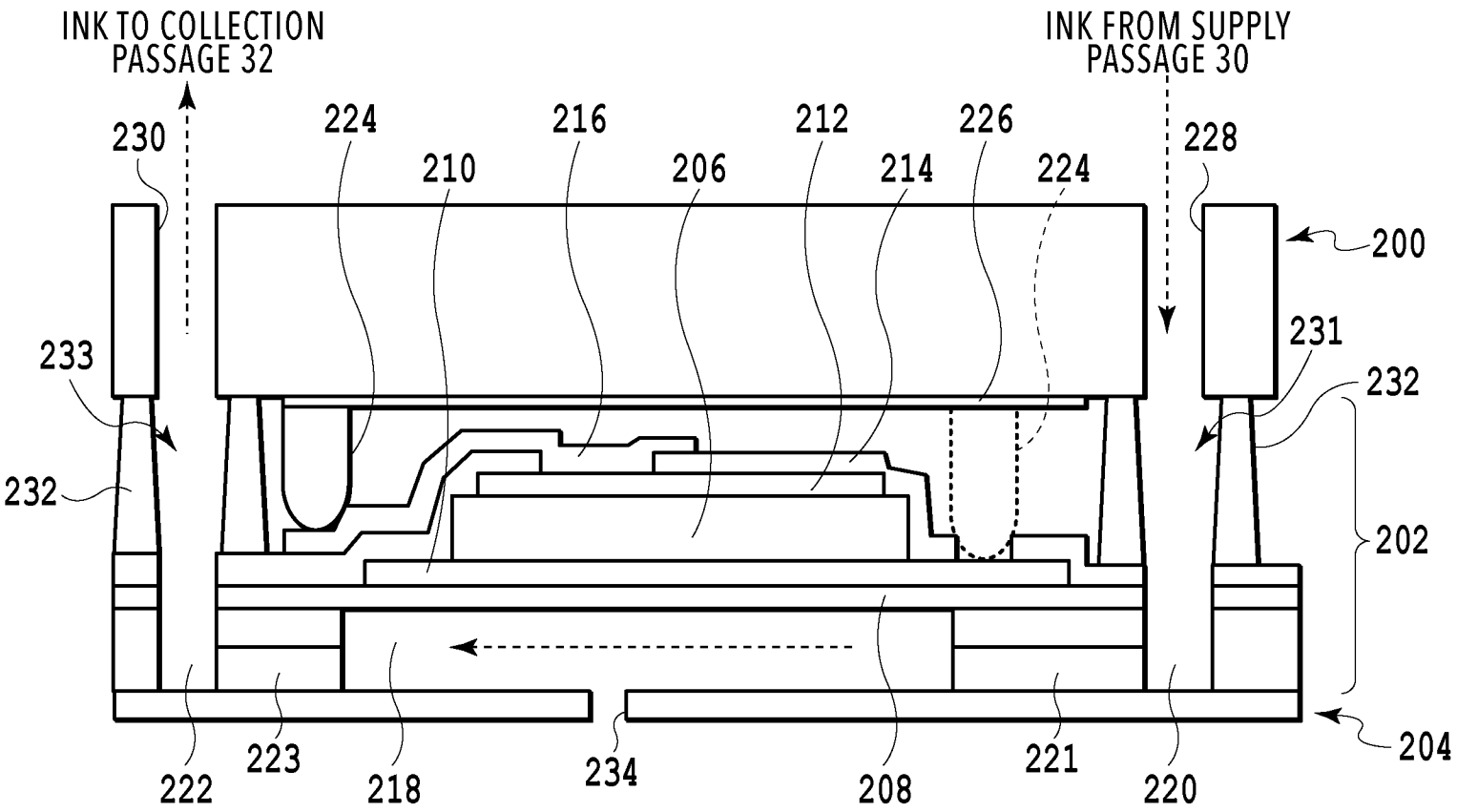
FIG. 3 is a schematic configuration view of an ink ejection mechanism in a print head.

First, a first embodiment of a printing apparatus according to the present invention is described with reference to FIGS. 1 to 6. FIG. 1 is a schematic configuration view of a main portion of the printing apparatus according to the present invention. FIG. 2 is a schematic configuration view of an ink supply system in the printing apparatus 10 according to the first embodiment of the present invention. FIG. 3 is a schematic configuration view of an ink ejection mechanism in a print head 16.

The printing apparatus 10 is a so-called full-line type inkjet printing apparatus and includes a conveying portion 12 which conveys a print medium M and a print portion 14 which performs printing by ejecting inks to the print medium M conveyed by the conveying portion 12. The ink supply system to be described later supplies the inks from an ink tank 18 to print heads 16 of the print portion 14. Moreover, a controller 100 (described later) controls entire operations of the printing apparatus 10.

In detail, the conveying portion 12 includes a drive roller 20 which is rotated by a motor 114 (see FIG. 5), a following roller 22 which is arranged away from the drive roller 20 at a predetermined interval, and a conveyance belt 24 endlessly stretched between the drive roller 20 and the following roller 22 in a tensioned manner. The drive roller 20 is rotated in a direction of the arrow A by drive of the motor 114. When the drive roller 20 is rotated in the direction of the arrow A, the conveyance belt 24 is rotated in the direction of the arrow B and the following roller 22 is rotated in the direction of the arrow C by the rotation of the conveyance belt 24. The print medium M is placed on the conveyance belt 24 and is conveyed in the direction of the arrow D by the rotation of the conveyance belt 24 in the direction of the arrow B. Note that the configuration of the conveying portion 12 is not limited to the configuration in which the conveyance belt 24 conveys the print medium M. Specifically, the configuration may be such that conveyance rollers capable of conveying the print medium M are arranged on upstream and downstream sides in a conveyance direction (direction of the arrow D) and the print medium M is conveyed by these conveyance rollers while being supported by a platen arranged between the conveyance rollers.

The print portion 14 includes the print heads 16. Four print heads 16 which respectively eject inks of different colors are arranged to be aligned in the conveyance direction. Specifically, a print head 16 which ejects a black ink, a print head 16 which ejects a cyan ink, a print head 16 which ejects a magenta ink, and a print head 16 which ejects a yellow ink are arranged in this order from the upstream side in the conveyance direction. Note that the relationships between the positions of the print heads 16 in the conveyance direction and the colors of inks ejected from the print heads 16 are not limited to those in the embodiment. Moreover, the number of print heads 16 is not limited to four and may be any of one to three and five or more depending on, for example, the colors of inks to be used and the usage frequency. Furthermore, for example, the print heads 16 are arranged to be replaceable.

As illustrated in FIG. 2, each of the print heads 16 is connected to a circulation route 26 through which the ink supplied from the ink tank 18 is circulated. The circulation route 26 includes a circulation ink tank 28 capable of storing a predetermined amount of ink, a supply passage 30 which supplies the ink from the circulation ink tank 28 to the print head 16, and a collection passage 32 which collects the ink from the print head 16 into the circulation ink tank 28. A sensor 34 which detects the concentration of the ink is provided in the collection passage 32. A correcting liquid tank 35 which stores a correcting liquid capable of correcting the concentration of the used ink such as a solvent of the used ink is connected to the collection passage 32. In the embodiment, "correcting the concentration of the ink" means "adjusting the ink to an appropriate concentration." The "appropriate concentration" is assumed to mean "concentration at which a predetermined favorable performance (for example, ejection performance) of the ink is maintained."

The circulation ink tank 28 stores the predetermined amount of ink supplied from the ink tank 18 and the stored ink is supplied to the print head 16 via the supply passage 30. Thereafter, the ink supplied to the print head 16 is collected into the circulation ink tank 28 via the collection passage 32. Specifically, the ink supplied from the circulation ink tank 28 through the supply passage 30 flows through an ink flow passage 236 (described later) which supplies the ink to ejection ports 234 (described later) in the print head 16 and is then sent back to the circulation ink tank 28 through the collection passage 32. In other words, the circulation route 26 is formed of the circulation ink tank 28, the supply passage 30, the ink flow passage 236 of the print head 16, and the collection passage 32. Note that, in the embodiment, as described later, the concentration of the ink is detected in the circulation route 26 and is corrected based on the result of this detection. Accordingly, in the embodiment, the ink in the circulation route 26 including the ink stored in the circulation ink tank 28 is an ink concentration management target.

The circulation ink tank 28 is connected to the ink tank 18 storing the ink with a predetermined concentration via a supply passage 36. The supply passage 36 is provided with a pump 38 which supplies the ink from the ink tank 18 to the circulation ink tank 28 and a valve 40 which opens and closes the supply passage 36. The ink is supplied from the ink tank 18 to the circulation ink tank 28 at a predetermined timing. Specifically, for example, a sensor (not illustrated) capable of detecting the amount of ink stored in the circulation ink tank 28 is provided. Then, when the sensor detects that the amount of ink reaches or falls below a certain amount, the controller 100 controls the drive of the pump 38 and the opening and closing of the valve 40 such that the ink is supplied from the ink tank 18 to the circulation ink tank 28.

The supply passage 30 connects the circulation ink tank 28 (storage unit) and the print head 16 to each other. The supply passage 30 is provided with a pump 42 which supplies the ink stored in the circulation ink tank 28 to the print head 16. The controller 100 controls the drive of the pump 42.

On the surface of the print head 16 facing the print medium M conveyed by the conveying portion 12, the multiple ejection ports 234 (described later) which eject the ink are formed to be aligned in the direction intersecting the conveyance direction. In the following description, the direction intersecting (orthogonal to) the conveyance direction is referred to as width direction of the print medium M or simply width direction. The length of a portion where the ejection ports 234 are formed in the width direction is a length capable of covering the maximum width of a print region in the printable print medium M.

As illustrated in FIG. 3, the print head 16 is configured such that a wiring board 200 is bonded to one side of a membrane substrate 202 and a nozzle substrate 204 is bonded to the other side of the membrane substrate 202. The membrane substrate 202 and the wiring board 200 are bonded to each other via gap formation members 232 (described later) and a piezoelectric body 206 and the like are arranged in a formed gap.

The piezoelectric body 206 which is an ejection energy generation element and a diaphragm 208 which forms an upper surface of a pressure chamber 218 (described later) are arranged on one surface (side bonded to the wiring board 200) of the membrane substrate 202. Moreover, a lower electrode 210 and an upper electrode 212 for applying voltage to the piezoelectric body 206 are arranged. The lower electrode 210 and the upper electrode 212 are covered with an insulating layer 214 together with the diaphragm 208, the piezoelectric body 206, and the like, except for certain portions thereof. Moreover, the lower electrode 210 is connected to a wiring electrode 226 of the wiring board 200 and the upper electrode 212 is connected to the wiring electrode 226 via a extraction electrode 216.

On the other surface (side bonded to the nozzle substrate 204) of the membrane substrate 202, there is formed the pressure chamber 218 whose volume changes with deformation of the diaphragm 208 caused by the piezoelectric body 206. Moreover, a supply hole 220 for supplying the ink to the pressure chamber 218 and a collection hole 222 for collecting the ink from the pressure chamber 218 are formed. The supply hole 220 and the collection hole 222 communicate with the pressure chamber 218 via flow passages 221, 223, respectively. In other words, the supply hole 220 and the collection hole 222 communicate with each other via the pressure chamber 218 and the flow passages 221, 223. Bonding the nozzle substrate 204 to the membrane substrate 202 allows the insides of the supply hole 220, the flow passage 221, the pressure chamber 218, the flow passage 223, and the collection hole 222 to be filled with the ink. The tubular gap formation members 232 are arranged respectively on the supply hole 220 and the collection hole 222. The gap formation members 232 cause a flow passage 228 (described later) of the wiring board 200 to communicate with the supply hole 220 and cause a flow passage 230 (described later) of the wiring board 200 to communicate with the collection hole 222 when the membrane substrate 202 and the wiring board 200 are bonded to each other.

The wiring electrode 226, which is electrically connected to the lower electrode 210 and the upper electrode 212 in the membrane substrate 202 via bumps 224, is arranged on the wiring board 200. Moreover, the wiring board 200 is provided with the flow passage 228 connected to the supply passage 30 and communicating with the supply hole 220 via the gap formation member 232. Furthermore, the wiring board 200 is provided with the flow passage 230 connected to the collection passage 32 and communicating with the collection hole 222 via the gap formation member 232. The flow passage 228, the gap formation member 232, the supply hole 220, and the flow passage 221 thereby form an ink supply passage 231 which supplies the ink from the supply passage 30 to the pressure chamber 218. Moreover, the flow passage 223, the collection hole 222, the gap formation member 232, and the flow passage 230 form an ink collection passage 233 which collects the ink in the pressure chamber 218 into the collection passage 32.

In the print head 16, the ink flowing into the pressure chamber 218 via the ink supply passage 231 flows out to the collection passage 32 via the ink collection passage 233 due to such a configuration. In other words, in the print head 16, the ink supply passage 231, the pressure chamber 218, and the ink collection passage 233 form the ink flow passage 236.

In the nozzle substrate 204, the ejection port 234 is formed at a position where the pressure chamber 218 is formed when the nozzle substrate 204 is bonded to the membrane substrate 202. Thus, when voltage is applied from the wiring electrode 226 to the piezoelectric body 206 via the upper electrode 212 and the lower electrode 210, the piezoelectric body 206 warps and the volume of the pressure chamber 218 is changed through the diaphragm 208. The ink is then ejected from the ejection port 234 in response to the volume change in the pressure chamber 218.

Returning to FIG. 2, the collection passage 32 connects the circulation ink tank 28 and the print head 16 to each other. The collection passage 32 is provided with a pump 44 which collects the ink in the print head 16 into the circulation ink tank 28. The controller 100 controls drive of the pump 44. The collection passage 32 is provided with the sensor 34 capable of detecting the ink concentration of the ink collected from the print head 16 into the circulation ink tank 28.

Figure 4:
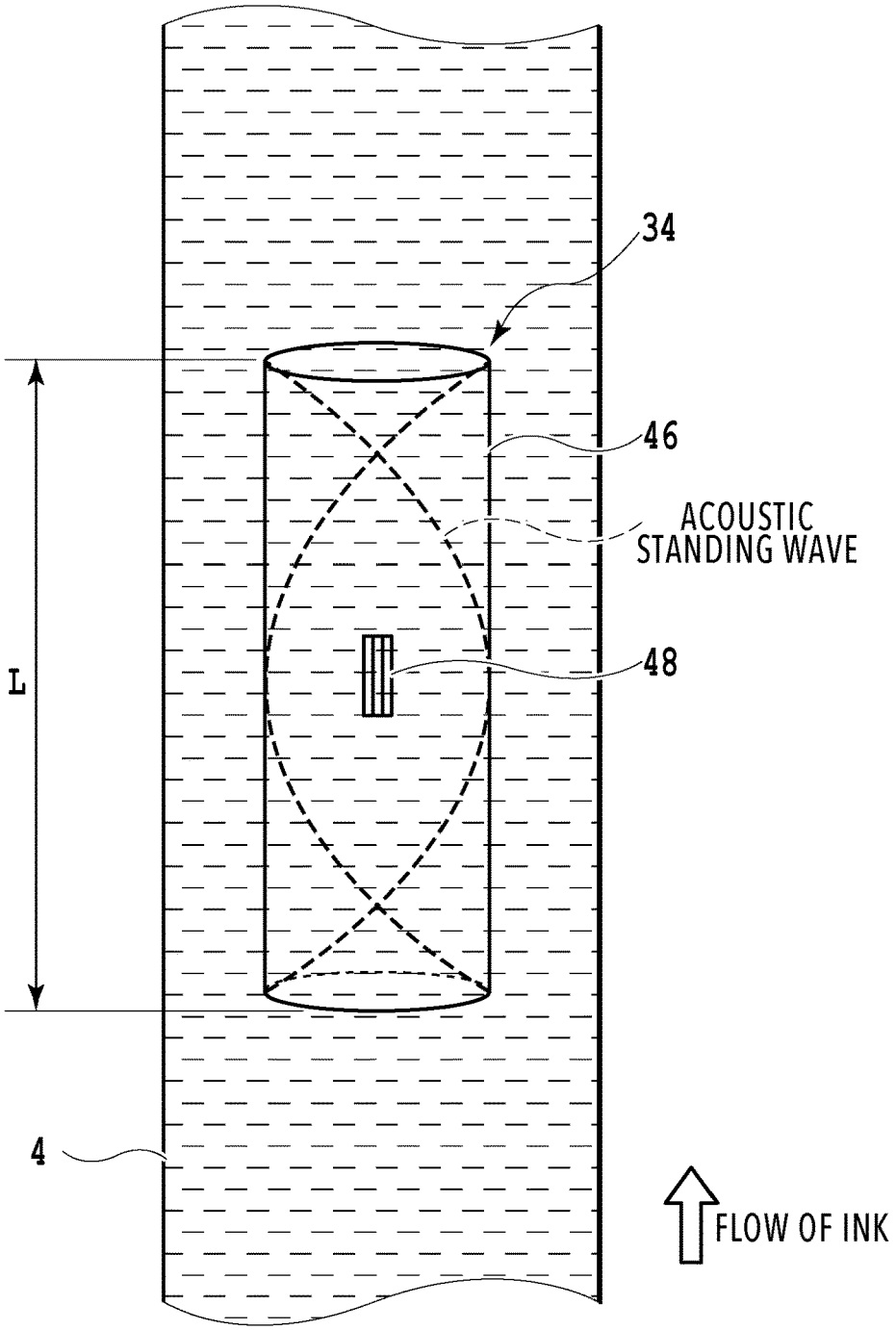
FIG. 4 is a schematic configuration view of a sensor.

Details of the sensor 34 are described with reference to FIG. 4. FIG. 4 is a schematic configuration diagram of the sensor 34. As illustrated in FIG. 2, the sensor 34 is arranged downstream of the print head 16 in the collection passage 32 and upstream of a position $P_0$ where the correcting liquid tank 35 is connected to the collection passage 32. In other words, the sensor 34 is arranged between the print head 16 and the position $P_0$. In the present description, an upstream side of an ink flow in the circulation route 26 is referred to as simply "upstream side" and a downstream side as "downstream side."

The sensor 34 includes a tubular resonance tube 46 open at both ends and a vibrator 48 such as a piezoelectric element arranged in the resonance tube. In the sensor 34, the resonance tube 46 is arranged in the collection passage 32 to extend parallel to the extending direction of the collection passage 32 so as not to hinder the flow of the ink in the collection passage 32. When the vibrator 48 arranged in the resonance tube 46 is made to vibrate, an acoustic standing wave correlated with the length L of the resonance tube 46 and the speed of sound V in the ink is generated. The vibrator 48 is arranged at an anti-node of this acoustic standing wave in the extending direction of the resonance tube 46 and, in the embodiment, is arranged at a center portion of the resonance tube 46. Note that the vibrator 48 may be arranged at an open end portion of the resonance tube 46.

The vibrator 48 is made to vibrate while changing the frequency in a state where the collection passage 32 is filled with the ink, and a resonance frequency f resonating with the resonance tube 46 can be thereby obtained. Specifically, the controller 100 performs control of making the vibrator 48 to vibrate while changing the frequency and detects the resonance of the resonance tube 46. Note that the resonance of the resonance tube 46 can be detected by, for example, detecting a voltage value of the vibrator 48. Then, the controller 100 obtains a frequency at which the resonance tube 46 resonates with the vibrator 48 as the resonance frequency f. The resonance frequency f corresponds to a ratio between the speed of sound V in the ink which varies depending on the ink concentration and the length L of the resonance tube 46. Accordingly, the ink concentration can be detected by obtaining the resonance frequency f. Since the speed of sound V in the ink depends on temperature, it is desirable to measure the ink temperature near the sensor 34 by using a measurement part (not illustrated) such as a thermocouple.

A data table which expresses relationships between the resonance frequency f and the ink concentration and which corresponds to the temperature dependency is created in advance and saved in, for example, a ROM 104 (described later) of the controller 100. The controller 100 obtains the resonance frequency f based on the detection result of the sensor 34 and obtains the ink concentration from the saved data table by using the obtained resonance frequency f. In other words, in the embodiment, the sensor 34 and the controller 100 function as a first detection unit configured to detect the ink concentration. Note that the sensor 34 is not limited to the aforementioned configuration and may use any publicly-known technique capable of directly or indirectly detecting the ink concentration. In this case, the sensor 34 preferably uses a method which does not hinder the flow of the ink in the collection passage 32. Moreover, the sensor 34 preferably uses a method which can detect the ink concentration at high speed with high resolution.

Returning to FIG. 2, the correcting liquid tank 35 storing the correcting liquid is connected to the collection passage 32. The correcting liquid is assumed to be a liquid such as a solvent in the used ink which is capable of correcting the concentration of the used ink without changing the characteristics (characteristics other than characteristics attributable to concentration) of the used ink. The correcting liquid tank 35 is connected to the collection passage 32 via a supply passage 50. The supply passage 50 is provided with a pump 52 which supplies the correcting liquid from the correcting liquid tank 35 to the collection passage 32, and a valve 54 which opens and closes the supply passage 50. Note that the controller 100 controls drive of the pump 52 and opening and closing of the valve 54. The position P0 where the correcting liquid tank 35 is connected to the collection passage 32 (position where the supply passage 50 is connected to the collection passage 32) is downstream of the sensor 34 and upstream of the circulation ink tank 28 (that is, between the sensor 34 and the circulation ink tank 28). Specifically, in the invention of the present application, the correcting liquid tank 35, the supply passage 50, the pump 52, and the valve 54 form a correcting liquid injection part 33 (injection unit) which injects the correcting liquid into the circulation route 26.

Since the print head 16 and the ink supply system to the print head 16 are configured as described above, a factor which causes changes in the concentration of the ink is mainly evaporation of an ink volatile component from the multiple ejection ports 234.

Figure 5:
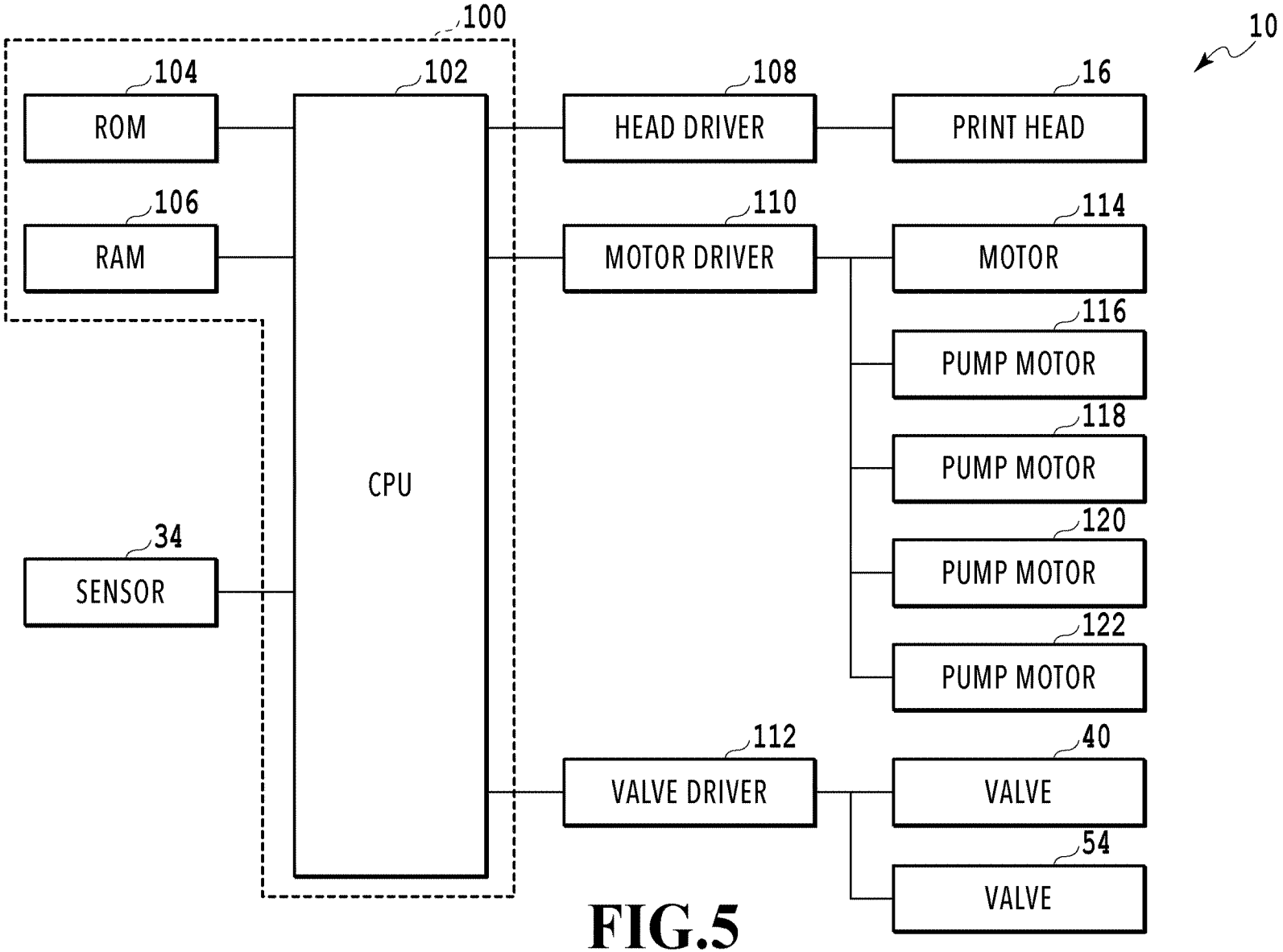
FIG. 5 is a block configuration diagram of a control system of the printing apparatus according to a first embodiment of the present invention.

Next, a configuration of a control system of the printing apparatus 10 is described with reference to FIG. 5. FIG. 5 is a block configuration diagram of the control system of the printing apparatus 10.

The controller 100 is formed of a central processing unit (CPU) 102, the ROM 104, and a RAM 106. The CPU 102 executes various types of processing such as a print operation, a circulation operation of the ink in the circulation route 26, and management of the ink concentration. The ROM 104 and the RAM 106 are connected to the CPU 102, the ROM 104 configured to store a predetermined program for executing the entire operations and the various types of processing, the RAM 106 serving as a working area in which various registers and the like necessary for execution of the program by the CPU 102 are set.

The sensor 34, a head driver 108, a motor driver 110, and a valve driver 112 are connected to the CPU 102. The head driver 108 is connected to the print head 16 and controls operations such as ejection of the ink from each ejection port 234 by using the piezoelectric body 206. The motor driver 110 controls the motor 114 to control the rotation of the drive roller 20. Moreover, the motor driver 110 controls a pump motor 116 to control the drive of the pump 38 and controls a pump motor 118 to control the drive of the pump 42. Furthermore, the motor driver 110 controls a pump motor 120 to control the drive of the pump 44 and controls a pump motor 122 to control the drive of the pump 52. The valve driver 112 is connected to the valves 40, 54 and controls the opening and closing of each valve.

Description is given of the case where the ink concentration is corrected in the printing apparatus 10 in the aforementioned configuration. In the print operation, the piezoelectric body 206 is driven via the wiring electrode 226 based on information relating to printing and the diaphragm 208 changes the volume of the pressure chamber 218 to eject the ink from the ejection port 234. In the print operation, since the ink is circulated in the circulation route 26, the volatile component in the ink evaporates from the ejection port 234 and the concentration of the ink in the circulation route 26 thereby increases over time. Moreover, also when the circulation of the ink in the circulation route 26 is stopped, for example, after completion of the printing, the volatile component in the ink evaporates from the ejection port 234 and the ink concentration in the ejection port 234 and the pressure chamber 218 increases over time. Accordingly, in the printing apparatus 10, concentration management processing of correcting the ink concentration is executed during the print operation and at a timing when a predetermined time elapses without processing such as printing being performed. In the following description, the concentration management processing according to the embodiment is referred to as "first concentration management processing."

Figure 6:
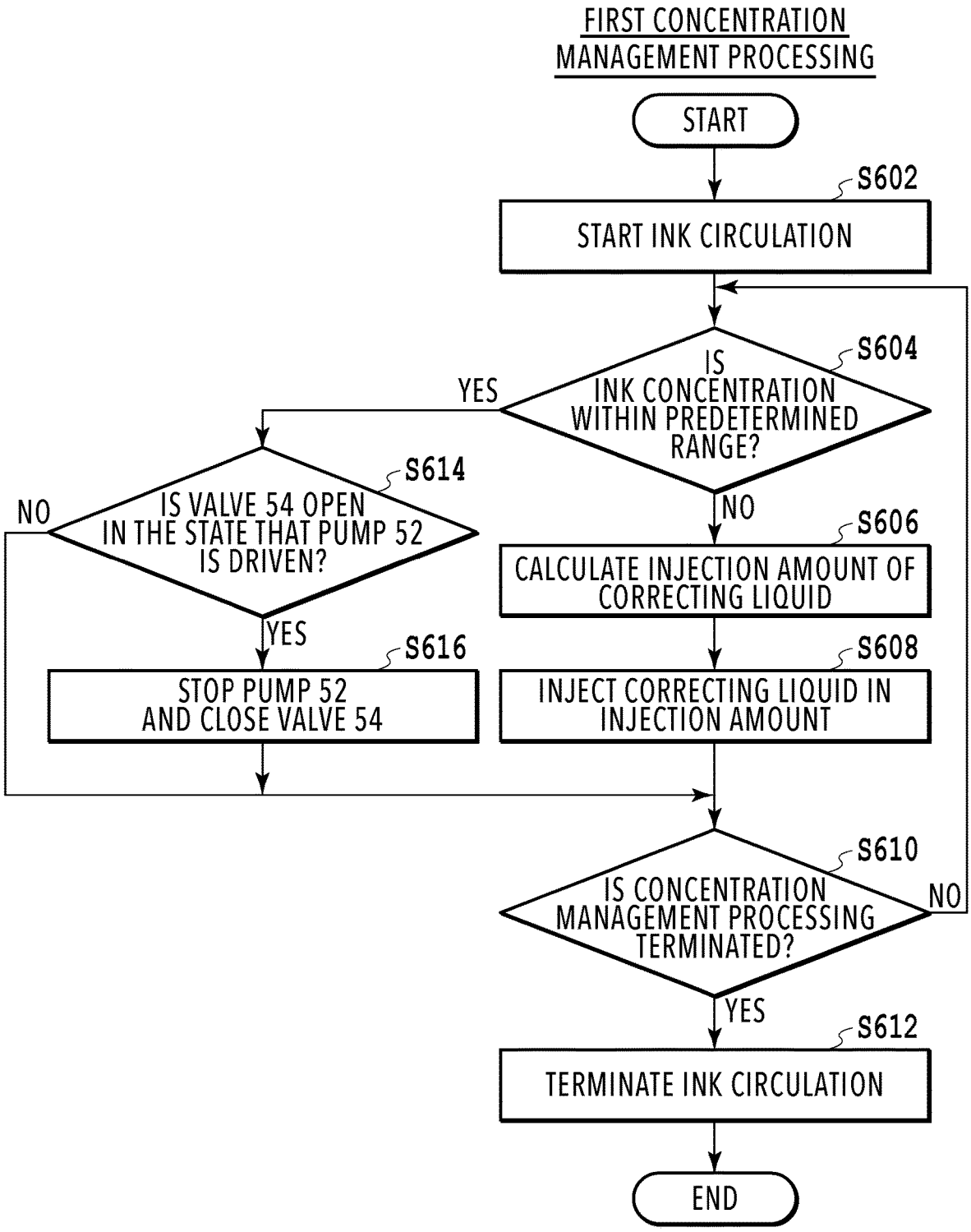
FIG. 6 is a flowchart illustrating a processing routine of first concentration management processing.

FIG. 6 is a flowchart illustrating detailed processing contents of the first concentration management processing. When the first concentration management processing is started, first, the circulation of the ink in the circulation route 26 is started (S602). Specifically, in step S602, the controller 100 drives the pump motors 118, 120 via the motor driver 110 and circulates the ink in the circulation route 26 by using the pumps 42, 44. Note that, in this case, the valve 54 is closed. This processing of S602 is omitted when the first concentration management processing is executed during the print operation.

Next, the controller 100 determines whether the ink concentration is within a predetermined range (S604). Specifically, in S604, the controller 100 obtains the ink concentration from the detection result of the sensor 34 based on the data table stored in advance. Then, the controller 100 determines whether the obtained ink concentration is within the predetermined range stored in advance. Note that the predetermined range is a range of the ink concentration in which appropriate characteristics of the ink (for example, ejection performance) appear and is stored in, for example, the ROM 104.

When the controller 100 determines that the ink concentration is not within the predetermined range (outside the predetermined range) in step S604, the controller 100 calculates an injection amount of the correcting liquid (S606). Specifically, in S606, the controller 100 calculates the injection amount of the correcting liquid based on the ink concentration obtained in S604 by using, for example, a calculation formula stored in advance. Note that the injection amount of the correcting liquid is calculated in consideration of, for example, the ink flow amount at the position $P_0$. Moreover, although the injection amount of the correcting liquid is calculated in step S606, the determination of the injection amount is not limited to this. Specifically, the determination may be such that a data table expressing the injection amount of the correcting liquid for each ink concentration is stored in the ROM 104 or the like and the injection amount of the correcting liquid based on the ink concentration is determined by referring to the data table.

Thereafter, the controller 100 causes the correcting liquid to be injected in the calculated injection amount (S608) and determines whether to terminate the first concentration management processing (S610). Specifically, in S608, the controller 100 opens the valve 54 via the valve driver 112 and drives the pump motor 122 via the motor driver 110 to cause the pump 52 to inject the correcting liquid stored in the correcting liquid tank 35 into the collection passage 32. In other words, the controller 100 controls the drive of the pump 52 and the opening degree of the valve 54 depending on the calculated injection amount. The ink requiring concentration correction and the correcting liquid are thereby mixed in the collection passage 32. Note that the timing of injecting the correcting liquid is set depending on the distance from the sensor 34 to the position $P_0$, the flow rate of the ink in the collection passage 32, and the like. In the embodiment, the controller 100 functions as a control unit which calculates the injection amount of the correcting liquid and controls the injection of the correcting liquid.

Moreover, in S610, in the case where the first concentration management processing is performed during the print operation, the controller 100 determines whether the print operation is completed. When the controller 100 determines that the print operation is completed, the controller 100 determines to terminate the first concentration management processing. When the controller 100 determines that the print operation is not completed, the controller 100 determines not to terminate the first concentration management processing. In the case where the first concentration management processing is performed at the timing when the predetermined time elapses without processing such as printing being performed, the controller 100 determines whether the predetermined time has elapsed from the latest print operation or completion of the first concentration management processing. Specifically, when the controller 100 determines that the predetermined time has elapsed, the controller 100 determines to terminate the first concentration management processing. When the controller 100 determines that the predetermined time has not elapsed, the controller 100 determines not to terminate the first concentration management processing. The predetermined time is stored in, for example, the ROM 104.

When the controller 100 determines not to terminate the first concentration management processing in step S610, the processing returns to S604 and the controller 100 executes the processing of S604 and beyond. When the controller 100 determines to terminate the first concentration management processing in step S610, the controller 100 terminates the ink circulation (S612) and terminates the first concentration management processing. Specifically, in S612, the controller 100 stops the pump motors 118, 120 driven via the motor driver 110 and causes the pumps 42, 44 to stop the ink circulation in the circulation route 26. Note that, when the first concentration management processing is executed during the print operation, the ink circulation is stopped upon the completion of the print operation. Accordingly, the processing of S612 is omitted.

When the controller 100 determines that the ink concentration is within the predetermined range in S604, the controller 100 determines whether the pump 52 is driven and the valve 54 is open (S614). Specifically, in S614, the controller 100 determines whether the pump motor 122 is driven and the valve 54 is open. When the controller 100 determines that the pump 52 is driven and the valve 54 is open in S614, the controller 100 stops the pump 52 and closes the valve 54 (S616) and the processing proceeds to S610. Meanwhile, when the controller 100 determines that the pump 52 is stopped and the valve 54 is closed in S614, the processing proceeds to S610.

Next, description is given of results of experiments performed by the inventors of the present application for the ink concentration in the case where the first concentration management processing is performed in the printing apparatus 10. In this experiment, there was used an ink with a composition of 5 wt % of yellow pigment subjected to dispersion processing, 15 wt % of diethylene glycol, 78 wt % of water, and 2 wt % of additives such as surfactant. Water was used as the correcting liquid. The range (aforementioned predetermined range) of ink concentration in which the appropriate ejection performance of the ink appears is 5.00±0.05 wt %. When the concentration of the ink exceeds 5.05 wt %, generation of satellite droplets in ink ejection and print concentration unevenness in printing are recognized.

The print head 16 was configured such that 12 head units having a print width of 1 inch and provided with the ejection ports 234 to achieve density of 1200 dpi in the width direction were linearly arranged to achieve the print width of 297 mm. In the head units, the ink supply passages 231 thereof were grouped and connected to one supply passage 30 and the ink collection passages 233 thereof were grouped and connected to one collection passage 32. Moreover, the volume of the circulation ink tank 28 was 1.5 L and the ink was circulated through the entire head units at 100 mL/sec. Note that, in this experiment, a sensor using the same method as the sensor 34 was installed in the circulation ink tank 28 to simultaneously measure changes in the ink concentration in the circulation ink tank 28.

In order to make the changes in the ink concentration due to evaporation of the ink from the ejection ports 234 more noticeable, the ink circulation was performed without the ejection from the ejection ports being performed. In this case, when the ink circulation was continuously executed without the first ink concentration being performed, the ink concertation reached 5.05 wt % after seven hours. The ink concentration continued increasing thereafter. Meanwhile, when the ink circulation was continuously executed with the first concentration management processing being performed, the ink concentration in the circulation ink tank 28 reached 5.02±0.02 wt % after 24 hours. In other words, the printing apparatus 10 was able to maintain the ink concentration within the range of 5.00±0.05 wt % in which there is no degrading of the ejection performance.

When printing was performed on the print medium M by ejecting the ink from the ejection ports 234 at a condition of print duty of 30% and the ink circulation was continuously executed with the first concentration management processing being performed, the ink concentration in the circulation ink tank 28 reached 5.01±0.02 wt % after 24 hours. In other words, the printing apparatus was able to maintain the ink concentration within the range of 5.00±0.05 wt % in which the eject characteristics do not degrade. Moreover, printed documents obtained 10 minutes, 10 hours, and 24 hours after the start of printing were checked and no print concentration unevenness was recognized.

As described above, in the printing apparatus 10, the controller 100 obtains the concentration of the circulated ink based on the detection result of the sensor 34 provided in the collection passage 32 of the circulation route 26 through which the ink is circulated. Then, when the controller 100 determines that the ink concentration based on the detection result of the sensor 34 exceeds the set predetermined range, the controller 100 calculates the injection amount of the correcting liquid for correcting the obtained ink concentration to an appropriate ink concentration and causes the correcting liquid to be injected downstream of the sensor 34 in the calculated injection amount.

The ink to be subjected to the concentration correction and the correcting liquid are thereby mixed in the collection passage 32 before reaching the circulation ink tank 28 and the case where the ink to be subjected to the concentration correction is contained in the circulation ink tank 28 is reduced. In other words, the ink with the concentration within the predetermined range continues to be collected in the circulation ink tank 28. Accordingly, in the printing apparatus 10, the concentration of the ink supplied from the circulation ink tank 28 to the print head 16 is maintained within the predetermined range and a decrease in print quality can be reduced compared to the technique of Japanese Patent Laid-Open No. 2005-153454 in which the adjustment ink is injected into the ink tank. Moreover, in the printing apparatus 10, since there is no need to provide multiple circulation ink tanks 28, the apparatus can be made smaller and stable printing can be continuously executed compared to the technique described in Published Japanese Patent Laid-Open No. H9-504756(1997) in which multiple reservoirs are provided.

Moreover, in some inks, the ejection performance degrades or print concentration unevenness occurs due to slight changes in the concentration. In the printing apparatus 10, a favorable ejection performance can be maintained also for such inks. Furthermore, a demand for improving the quality of printed documents is recently increasing. In the printing apparatus 10, an ink managed with higher accuracy can be supplied to the print head. Accordingly, in the printing apparatus 10, it is possible to suppress variations in the speed and volume of ejected ink droplets and generation of satellite droplets due to an increase in the viscosity of the ink caused by the concentration increase and maintain a favorable ejection performance, thereby suppressing print concentration unevenness in printed documents.

Second Embodiment

Figure 7A:
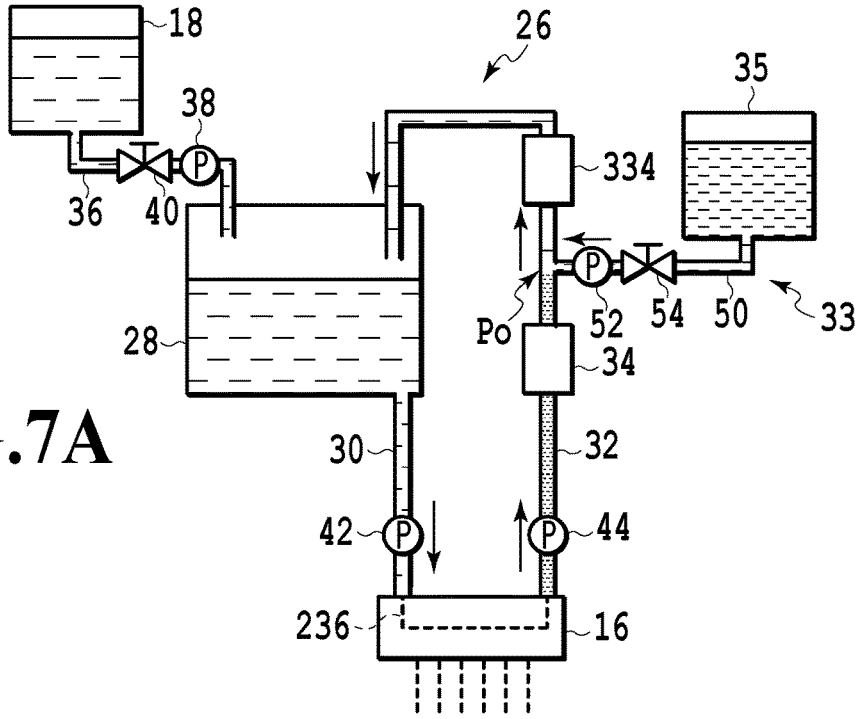
FIGS. 7A and 7B are explanatory views of an ink supply system and a control system in a printing apparatus according to a second embodiment of the present invention.
Figure 7B:
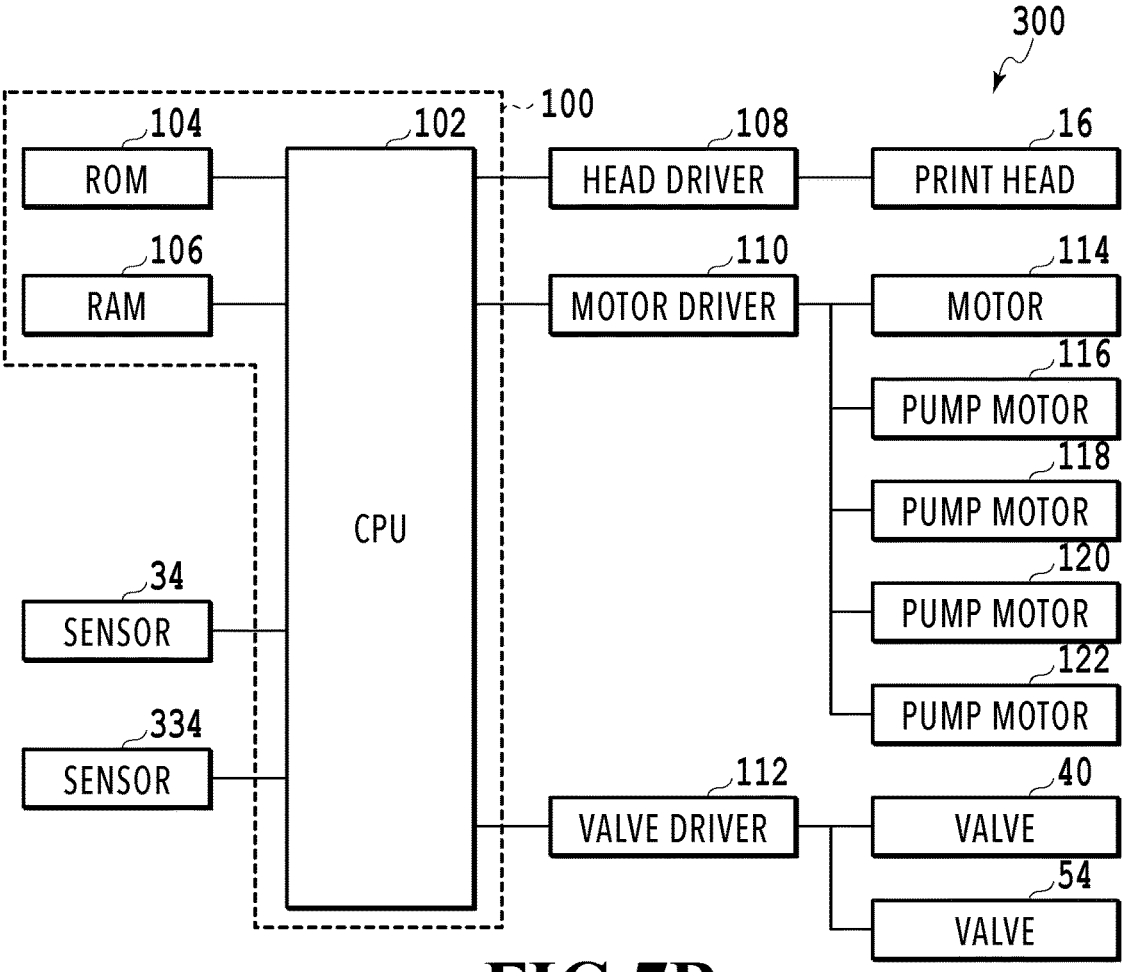

Next, a second embodiment of the printing apparatus according to the present invention is described with reference to FIGS. 7A, 7B, and 8. In the following description, configurations same as or corresponding to those in the aforementioned printing apparatus 10 are denoted by the same reference numerals and detailed description thereof is omitted as appropriate. FIG. 7A is a schematic configuration view of an ink supply system in a printing apparatus 300 according to the second embodiment of the present invention. FIG. 7B is a block configuration diagram of a control system of the printing apparatus 300.

The printing apparatus 300 according to the second embodiment is different from the aforementioned printing apparatus 10 in that a sensor 334 is arranged between the circulation ink tank 28 and the position $P_0$ where the correcting liquid tank 35 is connected to the collection passage 32, in the collection passage 32. The controller 100 obtains the resonance frequency f based on a detection result of the sensor 334 and obtains the ink concentration by using the obtained resonance frequency f and the data table (data table referred to when the ink concentration is obtained from the detection result of the sensor 34). In other words, in the embodiment, the sensor 334 and the controller 100 function as a second detection unit configured to detect the ink concentration (concertation of the ink after the injection of the correcting liquid). Since a specific configuration of the sensor 334 is the same as that of the aforementioned sensor 34, detailed description thereof is omitted.

Description is given of the case where the ink concentration is corrected in the printing apparatus 300 in the aforementioned configuration. Note that, in the printing apparatus 300, as in the printing apparatus 10, the concentration management processing of correcting the ink concentration is executed during the print operation and at the timing when the predetermined time elapses without processing such as printing being performed. In the following description, the concentration management processing according to the embodiment is referred to as "second concentration management processing."

Figure 8:
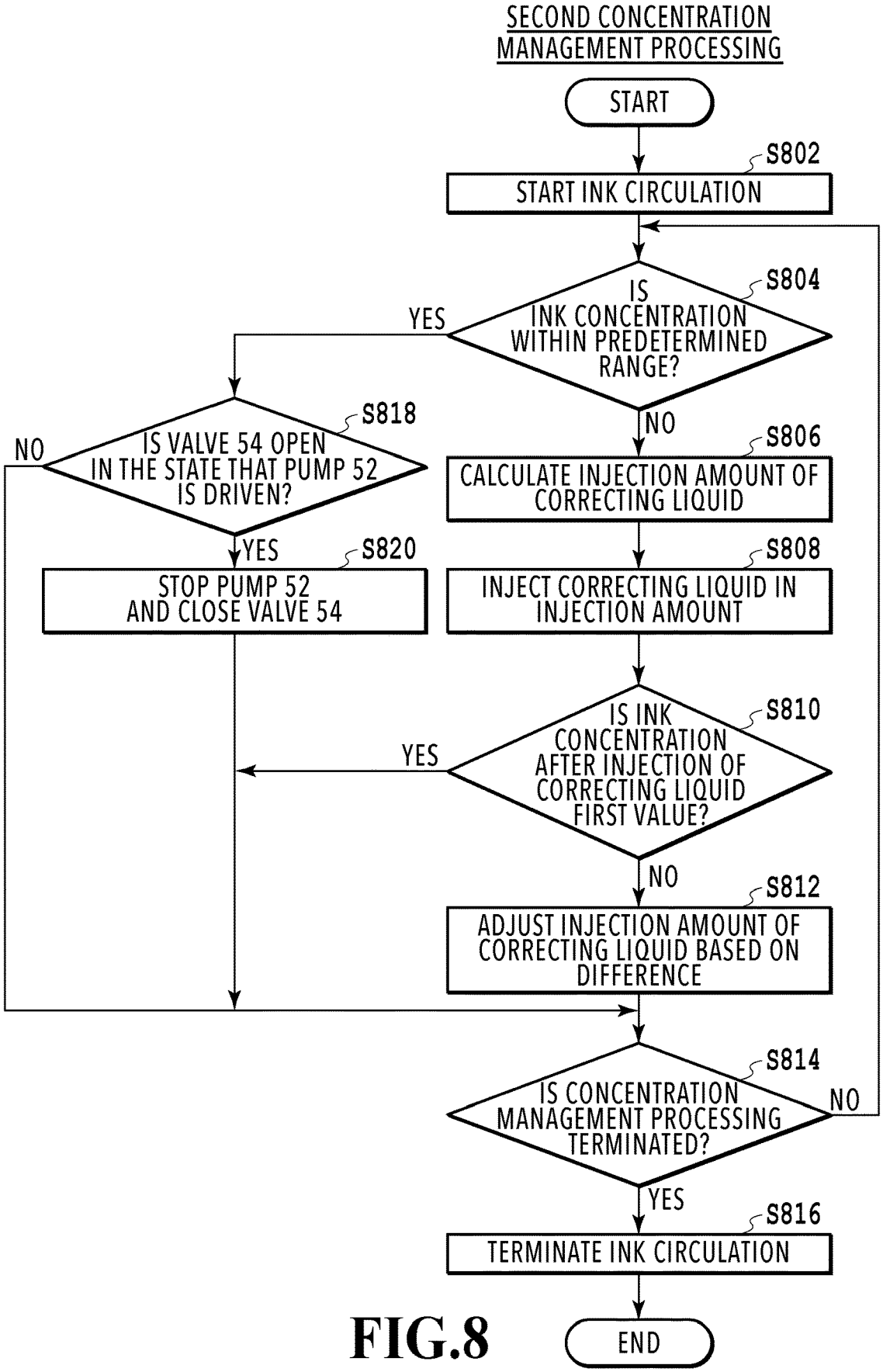
FIG. 8 is a flowchart illustrating a processing routine of second concentration management processing.

FIG. 8 is a flowchart illustrating detailed processing contents of the second concentration management processing. When the second concentration management processing is started, first, the circulation of the ink in the circulation route 26 is started (S802). Next, the controller 100 determines whether the ink concentration is within a predetermined range (S804). When the controller 100 determines that the ink concentration is not within the predetermined range in S804, the controller 100 calculates the injection amount of the correcting liquid (S806) and causes the correcting liquid to be injected in the calculated injection amount (S808). Since the specific processing contents of S802 to S808 are the same as those of S602 to S608 described above, description thereof is omitted.

Thereafter, the controller 100 determines whether the ink concentration after the injection of the correcting liquid is a first value (S810). Specifically, in S810, the controller 100 determines whether the ink concentration obtained based on the detection result of the sensor 334 matches the first value. Note that the first value (first concentration information) is a value within the aforementioned predetermined range and is, for example, a median of the predetermined range. Specifically, the first value is 5.00 wt % in the case where the predetermined range is 5.00±0.05 wt %.

When the controller 100 determines that the ink concentration is the first value in S810, the processing proceeds to S814 to be described later. Meanwhile, when the controller 100 determines that the ink concentration is not the first value in S810, the controller 100 adjusts the injection amount of the correcting liquid based on the difference between the first value and the ink concentration after the injection of the correcting liquid (S812). Specifically, in S812, when the controller 100 determines that the ink concentration obtained based on the detection result of the sensor 334 is greater than the first value, the controller 100 adjusts the drive of the pump 52 and the opening degree of the valve 54 such that more correcting liquid is injected. Meanwhile, when the controller 100 determines that the ink concentration is smaller than the first value, the controller 100 adjusts the drive of the pump 52 and the opening degree of the valve 54 such that less correcting liquid is injected.

In this case, the controller 100 calculates adjustment amounts of the drive of the pump 52 and the opening degree of the valve 54 depending on, for example, the difference between the first value and the ink concentration obtained based on the sensor 334. Moreover, in step S812, the controller 100 may adjust both or one of the drive of the pump 52 and the opening degree of the valve 54. In other words, in the second concentration management processing, the injection mechanism (pump 52, valve 54) which injects the correcting liquid is adjusted based on the calculated injection amount in step S808 and is adjusted to achieve a more appropriate injection amount in step S812.

Next, the controller 100 determines whether to terminate the second concentration management processing (S814). When the controller 100 determines not to terminate the second concentration management processing in S814, the process returns to step S804 and the controller 100 executes the processing of step S804 and beyond. Meanwhile, when the controller 100 determines to terminate the second concentration management processing, the controller 100 terminates the circulation of the ink (S816) and terminates the second management processing. Since specific processing contents of S814, S816 are the same as those of S610, S612, description thereof is omitted.

When the controller 100 determines that the ink concentration is within the predetermined range in S804, the controller 100 determines whether the pump 52 is driven and the valve 54 is open (S818). When the controller 100 determines that the pump 52 is stopped and the valve 54 is closed in S818, the processing proceeds to S814 and the controller 100 executes the processing of S814 and beyond. Meanwhile, when the controller 100 determines that the pump 52 is driven and the valve 54 is open in S818, the controller 100 stops the pump 52 and closes the valve 54 (S820). Then, the processing proceeds to S814 and the controller 100 executes the processing of S814 and beyond. Since specific processing contents of S818, S820 are the same as those of S614, S616, description thereof is omitted.

Next, description is given of results of experiments performed by the inventors for the ink concentration in the case where the second concentration management processing is performed in the printing apparatus 300. Note that conditions of this experiment were the same as the experiment conditions of the printing apparatus 10 according to the first embodiment. The ink circulation was continuously executed with the second concentration management processing being performed and without the ejection from the ejection ports 234 being performed. In this case, the ink concentration in the circulation ink tank 28 reached 5.02±0.015 wt % after 24 hours. In other words, the printing apparatus 300 was able to maintain the ink concentration within the range of 5.00±0.05 wt % in which there is no degrading of the ejection performance. Moreover, the variation width of the ink concentration was smaller than that in the printing apparatus 10 and the printing apparatus 300 was able to manage the concertation more strictly.

As described above, the printing apparatus 300 has such a configuration that the ink concentration after the injection of the correcting liquid is obtained based on the detection result of the sensor 334 provided downstream of the position $P_0$ where the correcting liquid is injected in the collection passage 32, in addition to the configurations of the aforementioned printing apparatus 10. Then, when the controller 100 determines that the ink concentration based on the sensor 334 does not match the first value in the predetermined range, the controller 100 adjusts the pump 52 and the valve 54 for injecting the correcting liquid to adjust the injection amount of the correcting liquid.

The printing apparatus 300 can thus more strictly adjust the ink concentration to the target concentration, while achieving the operations and effects similar to those of the printing apparatus 10. Specifically, the injection amount of the correcting liquid sometimes varies due to variation in the drive of the pump 52 and variation in the opening degree of the valve 54. Also in such case, in the printing apparatus 300, the ink can have concentration closer to the target concentration by measuring the concertation of the ink into which the correcting liquid is injected and adjusting the drive of the pump 52 and the opening degree of the valve 54 based on the measurement result. Moreover, also in the case where the correcting liquid is a mixed solution of multiple types of liquids, it is possible to correct an effect of variation in the ratio of the liquids in the mixed solution on the ink concentration and more strictly adjust the concentration of the circulated ink to the target ink concentration.

Third Embodiment

Figure 9A:
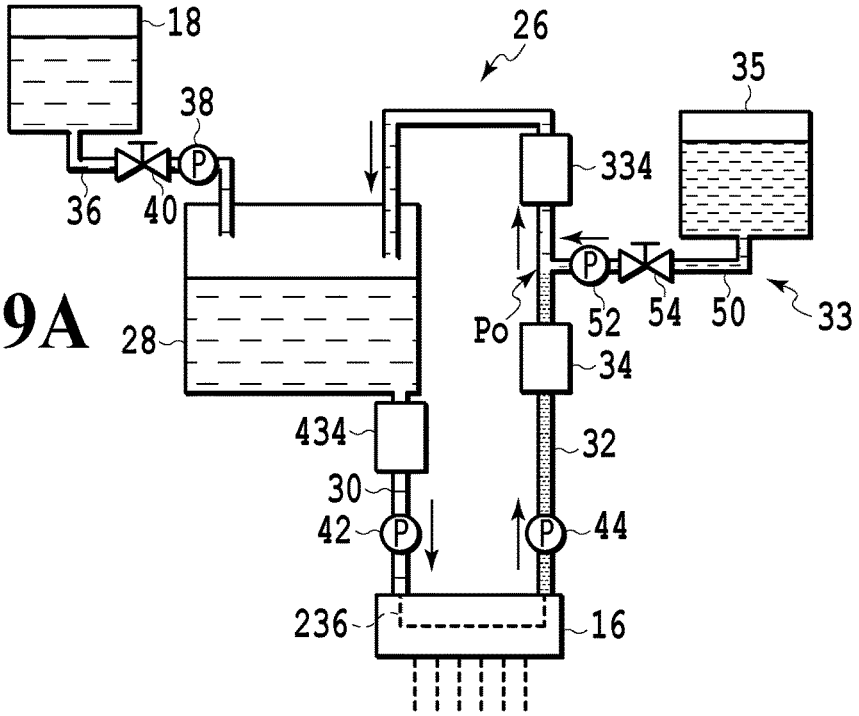
FIGS. 9A and 9B are explanatory views of an ink supply system and a control system in a printing apparatus according to a third embodiment of the present invention.
Figure 9B:
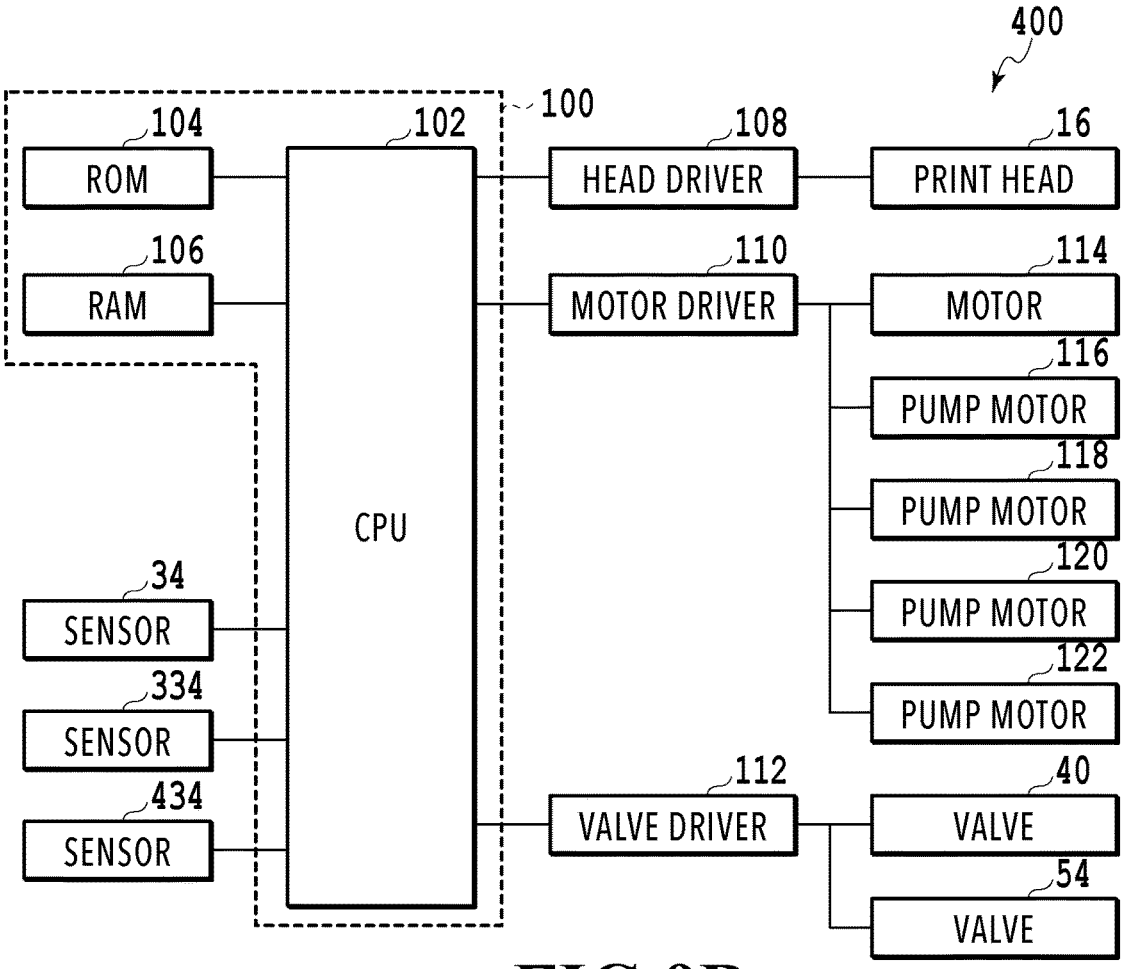

Next, a third embodiment of the printing apparatus according to the present invention is described with reference to FIGS. 9A, 9B, 10A and 10B. In the following description, configurations same as or corresponding to those in the aforementioned printing apparatuses 10, 300 are denoted by the same reference numerals and detailed description thereof is omitted as appropriate. FIG. 9A is a schematic configuration view of an ink supply system in a printing apparatus 400 according to the third embodiment of the present invention. FIG. 9B is a block configuration diagram of a control system of the printing apparatus 400.

The printing apparatus 400 according to the third embodiment is different from the aforementioned printing apparatus 300 in that a sensor 434 is arranged in the supply passage 30. Specifically, the printing apparatus 400 is different from the aforementioned printing apparatus 10 in that the sensors 334, 434 are provided in the circulation route 26. Moreover, the printing apparatus 400 is different from the aforementioned printing apparatus 300 in that the sensor 434 is provided in the circulation route 26. The controller 100 obtains the resonance frequency f based on a detection result of the sensor 434 and obtains the ink concentration by using the obtained resonance frequency f and the data table (data table referred to when the ink concentration is obtained from the detection result of the sensor 34). In other words, in the embodiment, the sensor 434 and the controller 100 function as a third detection unit configured to detect the ink concentration (concertation of the ink to be supplied from the circulation ink tank 28 to the print head 16). Since a specific configuration of the sensor 434 is the same as that of the aforementioned sensor 34, detailed description thereof is omitted.

Description is given of the case where the ink concentration is corrected in the printing apparatus 400 in the aforementioned configuration. Note that, in the printing apparatus 400, as in the printing apparatuses 10, 300, the concentration management processing of correcting the ink concentration is executed during the print operation and at the timing when the predetermined time elapses without processing such as printing being performed. In the following description, the concentration management processing according to the embodiment is referred to as "third concentration management processing."

Figures 10, 10A:
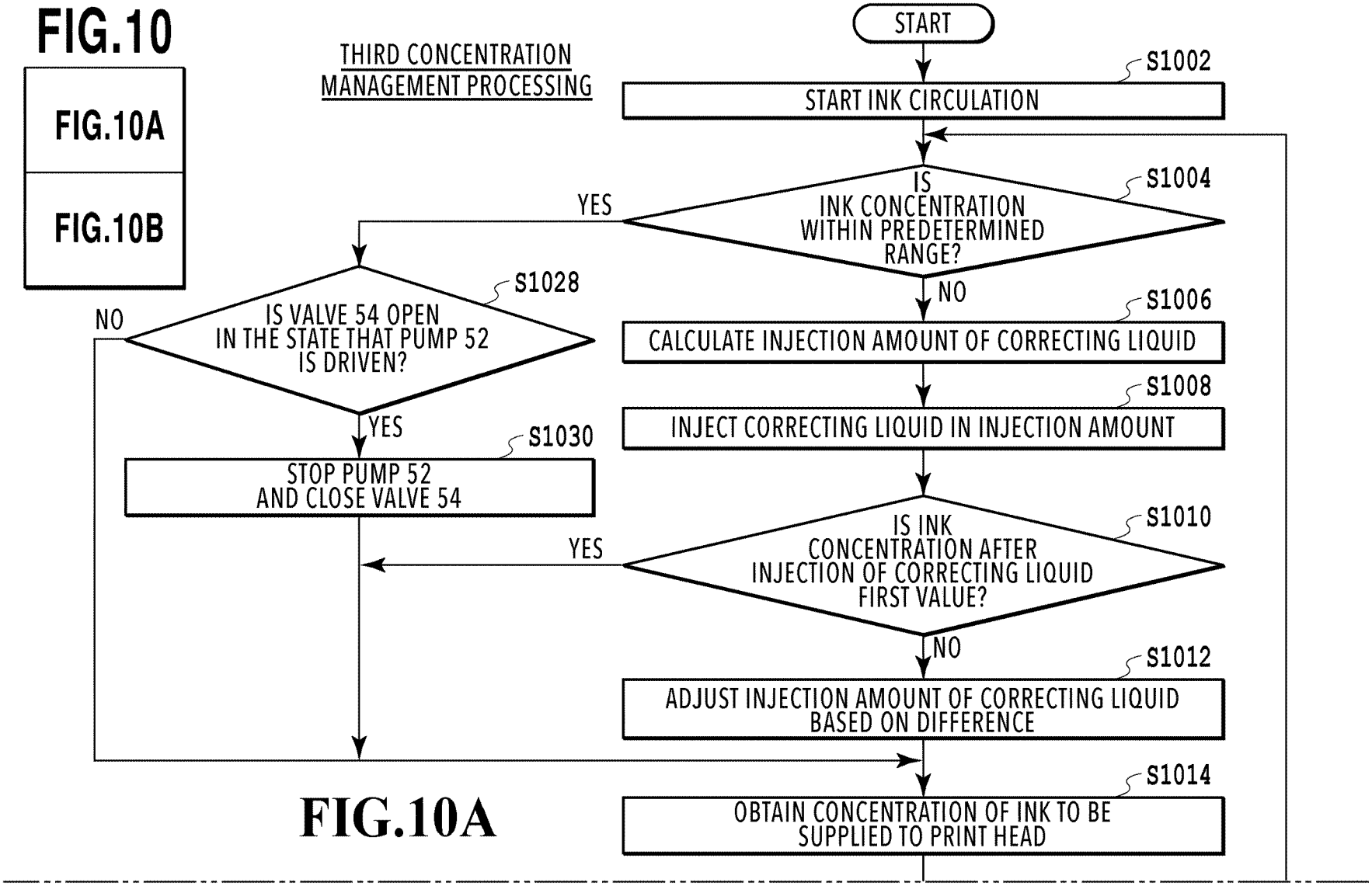
FIG. 10 is a diagram showing a relation between FIGS. 10A and 10B.
FIGS. 10A and 10B are flowcharts illustrating a processing routine of third concentration management processing.
Figure 10B:
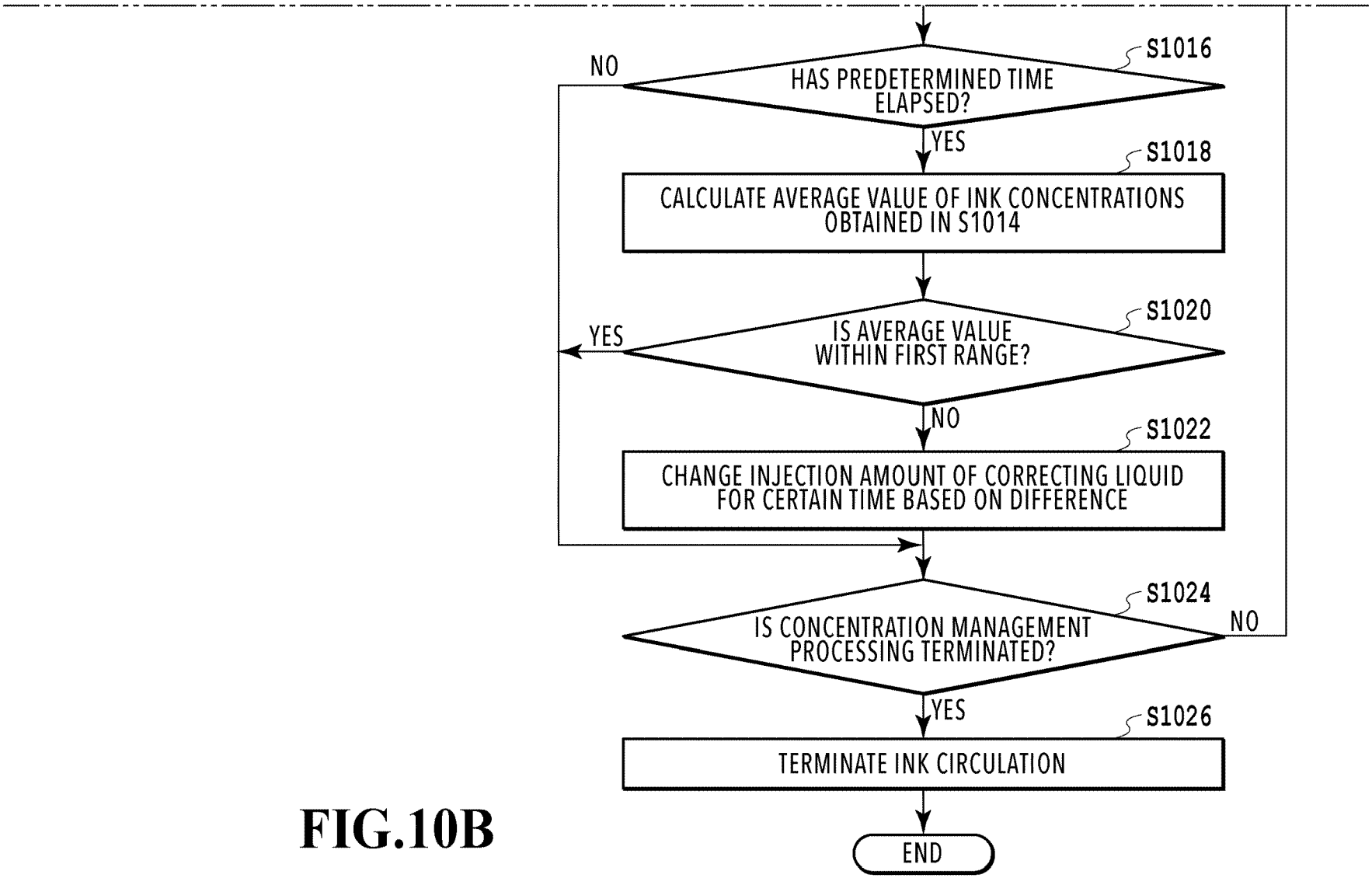

FIGS. 10A and 10B are flowcharts illustrating detailed processing contents of the third concentration management processing. When the third concentration management processing is started, first, the circulation of the ink in the circulation route 26 is started (S1002). Next, the controller 100 determines whether the ink concentration is within a predetermined range (S1004). When the controller 100 determines that the ink concentration is not within the predetermined range in step S1004, the controller 100 calculates the injection amount of the correcting liquid (S1006) and causes the correcting liquid to be injected in the calculated injection amount (S1008). Thereafter, the controller 100 determines whether the ink concentration after the injection of the correcting liquid is the first value (S1010). When the controller 100 determines that the ink concentration is the first value in S1010, the processing proceeds to S1014 to be described later. Meanwhile, when the controller 100 determines that the ink concentration is not the first value in S1010, the controller 100 adjusts the injection amount of the correcting liquid based on the difference between the first value and the ink concentration after the injection of the correcting liquid (S1012). Since the specific processing contents of S1002 to S1012 are the same as those of S802 to S812 described above, description thereof is omitted.

Next, the controller 100 obtains the concentration of the ink to be supplied to the print head 16 (S1014). Specifically, in S1014, the controller 100 obtains the concentration of the ink to be supplied from the circulation ink tank 28 to the print head 16 based on the detection result of the sensor 434. Note that the ink concentration obtained as described above is stored. Then, the controller 100 determines whether the predetermined time has elapsed (S1016). In the embodiment, time count is started when the ink concentration is obtained in S1014. Moreover, when the ink concentration is obtained based on the detection result of the sensor 434 for the first time in the third concentration management processing, the time count is started after initialization of counted time. When the counted time is initialized, the stored ink concentration is also initialized. Accordingly, in S1016, the controller 100 determines whether this counted time has reached the predetermined time.

When the controller 100 determines that the predetermined time has not elapsed in S1016, that is the counted time has not reached the predetermined time, the processing proceeds to S1024 to be described later. Meanwhile, when the controller 100 determines that the predetermined time has elapsed, that is the counted time has reached the predetermined time in S1016, the controller 100 calculates an average value of the ink concentrations obtained in S1016. The obtaining of the ink concentration in S1014 is continued until the predetermined time elapses and the obtained ink concentrations are stored. Accordingly, in S1018, the controller 100 calculates the average value of the thus-stored multiple ink concentrations. Note that, after the calculation of the average value, the stored ink concentrations are initialized and the counted time is also initialized.

Then, the controller 100 determines whether the calculated average value of the ink concentrations is within a first range (S1020). The first range (second concentration information) is a range smaller than the predetermined range and a median of the first range is the same as that of the predetermined range. For example, when the predetermined range is 5.00±0.05 wt %, the first range is 5.00±0.02 wt %. When the controller 100 determines that the average value is within the first range in S1020, the processing proceeds to S1024 to be described later.

Meanwhile, when the controller 100 determines that the average value is not within the first range (outside the first range) in S1020, the controller 100 changes the injection amount of the correcting liquid by a certain percentage for a certain time (S1022). Specifically, when the controller 100 determines that the average value of the ink concentrations obtained in the S1018 is higher than (above) the first range, in S1022, the controller 100 increases the injection amount of the correcting liquid by the predetermined percentage. Meanwhile, when the controller 100 determines that the average value is lower than (below) the first range, the controller 100 reduces the injection amount of the correcting liquid by the predetermined percentage. Specifically, assume that the first range is set to be higher than 4.98 wt % and lower than 5.02 wt %. In this case, when the average value is 5.02 wt % or higher, the controller 100 increases the injection amount of the correcting liquid by 10% for the certain time. Meanwhile, when the average value is 4.98 wt % or lower, the controller 100 reduces the injection amount of the correcting liquid by 10% for the certain time. When the average value is within the first range, the controller 100 does not change the injection amount of the correcting liquid.

When changing the injection amount of the correcting liquid, the controller 100 adjusts the injection mechanism (pump 52, valve 54) of the correcting liquid depending on the percentage of increasing or decreasing the correcting liquid. Also in this case, the controller 100 may adjust both or one of the drive of the pump 52 and the opening degree of the valve 54. Moreover, S1020 may be such that the first range is set to the first value and the controller 100 changes the time and percentage of changing the injection amount of the correcting liquid based on the difference between the average value and the first value. The ink concentration can be thereby more strictly managed.

Next, the controller 100 determines whether to terminate the third concentration management processing (S1024). When the controller 100 determines not to terminate the third concentration management processing in S1024, the processing returns to S1004 and the controller 100 executes the processing of S1004 and beyond. Meanwhile, when the controller 100 determines to terminate the third concentration management processing in S1024, the controller 100 terminates the ink circulation (S1026) and terminates the third management processing. Since the specific processing contents of S1024 and S1026 are the same as those of 610 and 612, description thereof is omitted.

When the controller 100 determines that the ink concentration is within the predetermined range in S1004, the controller 100 determines whether the pump 52 is driven and the valve 54 is open (S1028). When the controller 100 determines that the pump 52 is stopped and the valve 54 is closed in S1028, the processing proceeds to S1014 and the controller 100 executes the processing of S1014 and beyond. Meanwhile, when the controller 100 determines that the pump 52 is driven and the valve 54 is open in S1028, the controller 100 stops the pump 52 and closes the valve 54 (S1030). Then, the processing proceeds to S1014 and the controller 100 executes the processing of S1014 and beyond. Since specific processing contents of S1028, S1030 are the same as those of S614, S616, description thereof is omitted.

Next, description is given of results of experiments performed by the inventors for the ink concentration in the case where the third concentration management processing is performed in the printing apparatus 400. Note that the injection amount of the correcting liquid was increased by 10% for one minute when the average value of the ink concentrations was 5.02 wt % or more and was reduced by 10% for one minute when the average value of the ink concentrations was 4.98 wt % or less. Moreover, the concentration of the ink to be supplied to the print head 16 was the average value at the moment when five minutes elapsed. Other conditions of this experiment were the same as the experiment conditions of the printing apparatus 10 according to the first embodiment.

When the ink circulation was continuously executed with the third concentration management processing being performed and without the ejection from the ejection ports 234 being performed, the concentration of the ink to be supplied to the print head 16 reached 5.01±0.012 wt %. In other words, the printing apparatus 400 was able to maintain the ink concentration within the range of 5.00±0.05 wt % in which there is no degrading of the ejection performance. Moreover, the printing apparatus 400 was able to bring the ink concentration closer to 5.00 wt % which is the median and manage the concertation more strictly than the printing apparatuses 10, 300 were.

As described above, the printing apparatus 400 has such a configuration that the concentration of the ink to be supplied to the print head 16 is obtained based on the detection result of the sensor 434 provided between the circulation ink tank 28 and the print head 16, in addition to the configurations of the aforementioned printing apparatus 300. Moreover, when the controller 100 determines that the average value of the ink concentrations obtained based on the sensor 434 in the predetermined time is not within the first range, the controller 100 adjusts the pump 52 and the valve 54 to change the injection amount of the correcting liquid by the certain percentage for the certain time. The printing apparatus 400 can thus adjust the ink in the circulation ink tank in which the ink subjected to the concentration correction by using the correcting liquid is collected, to the median of the predetermined range, while achieving effects similar to those of the printing apparatus 300. Accordingly, the concentration of the circulated ink can be more strictly managed.

Other Embodiments

The embodiments described above may be modified as described in the following sections (1) to (6).

Figure 11:
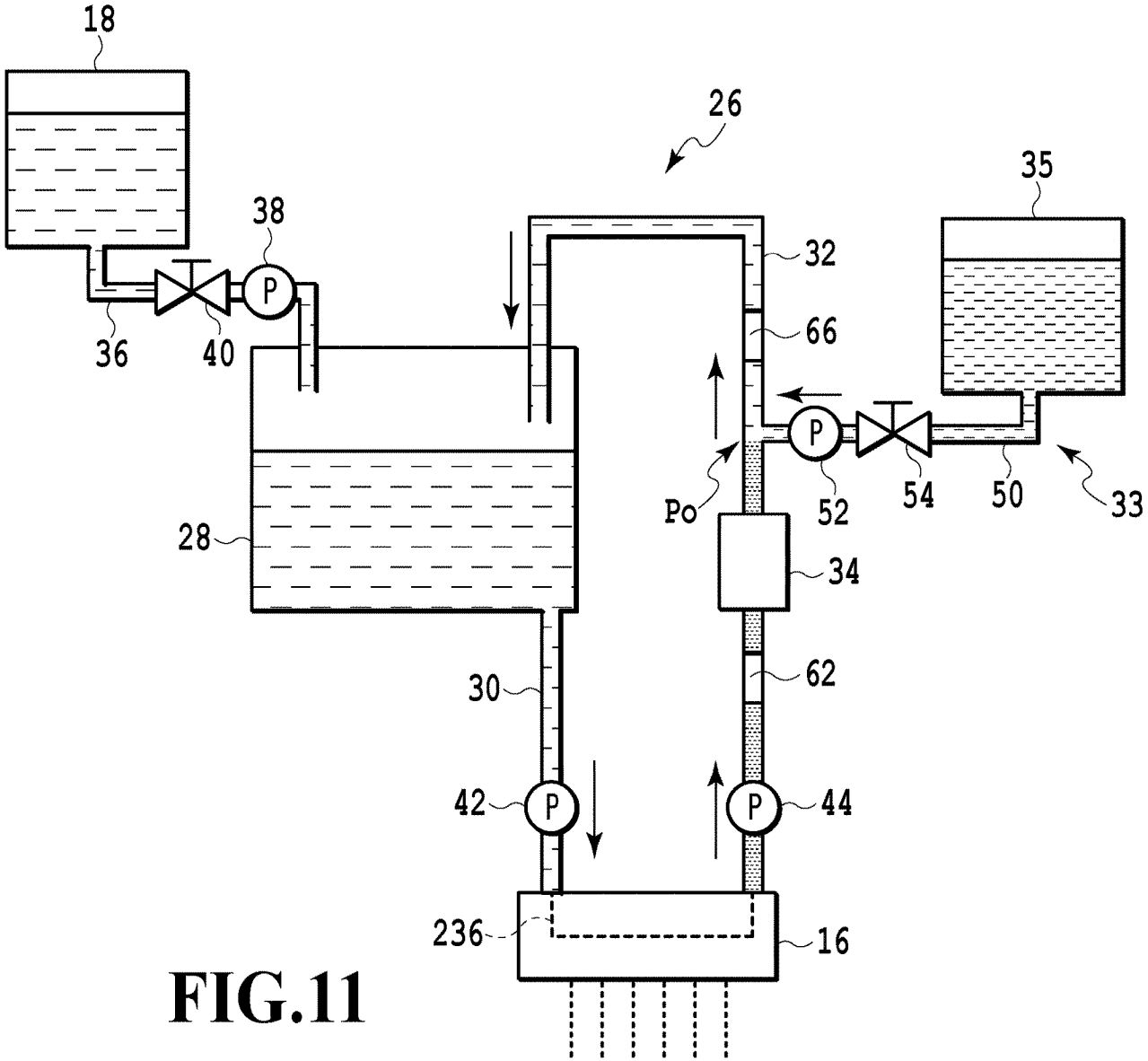
FIG. 11 is an explanatory view illustrating a modified example of the ink supply system.

(1) Although not particularly described in the aforementioned embodiments, a configuration which can agitate the ink flowing through the collection passage 32 may be provided between the circulation ink tank 28 and the position $P_0$ where the correcting liquid tank 35 is connected to the collection passage 32, in the collection passage 32. For example, as illustrated in FIG. 11, an inline agitating-mixing flow passage 66 (agitating unit) may be provided downstream of the position $P_0$ of the collection passage 32 and upstream of the circulation ink tank 28. The ink to be subjected to the concentration correction and the correcting liquid can be thereby surely mixed before being collected into the circulation ink tank 28. Thus, the case where the ink to be subjected to the concentration correction is contained in the circulation ink tank 28 can be further suppressed. Such an agitation configuration is arranged upstream of the sensor 334 in the aforementioned second and third embodiments.

(2) Although not particularly described in the aforementioned embodiments, as illustrated in FIG. 11, the printing apparatus may be configured such that a flowmeter 62 (measurement unit) is arranged in the collection passage 32 and the injection amount of the correcting liquid is calculated in consideration of flow amount information of the flowmeter. Moreover, although not particularly described in the aforementioned embodiments, when the range (aforementioned predetermined range) of the ink concentration in which the appropriate ejection performance of the ink appears is large, the correcting liquid of the calculated injection amount may be injected dividedly at certain intervals.

(3) Although the circulation route 26 includes the circulation ink tank 28 configured to store the ink in the aforementioned embodiments, the circulation route 26 is not limited to this configuration. Specifically, the circulation route 26 does not have to include the circulation ink tank 28 as long as it includes any configuration in which the ink to be subjected to the concentration correction is corrected to a concentration within the predetermined range by using the correcting liquid before reaching the print head 16 such as, for example, a configuration for agitating the ink flowing through the collection passage 32.

(4) Although the solvent of the used ink is used as the correcting liquid in the aforementioned embodiments, the correcting liquid is not limited to this. Specifically, a high-concentration ink a may be used as the correcting liquid to correct the concentration of the ink with a decreased concentration. Moreover, a configuration which can selectively inject either the solvent or the high-concentration ink as the correcting liquid at the position $P_0$ may be provided. In this case, the high-concentration ink is injected as the correcting liquid when the ink concentration falls below the lower limit of the predetermined range and the solvent is injected as the correcting liquid when the ink concentration exceeds the upper limit of the predetermined range.

(5) No sensor 334 may be provided in the aforementioned third embodiment. Moreover, although the piezoelectric body 206 is provided as the ejection energy generation element in the print head 16 in the aforementioned embodiments, the ejection energy generation element is not limited to this. Specifically, the print head 16 may be configured as follows: an electro-thermal converter (heater) is provided as the ejection energy generation element; the electro-thermal converter applies thermal energy to the ink to cause film boiling and form air bubbles; and thus-formed air bubbles cause the ink to be ejected.

(6) Although the injection amount of the correcting liquid is adjusted by controlling the pump 52 and the valve 54 based on the difference between the first value and the ink concentration after the injection of the correcting liquid in the aforementioned second and third embodiments, the adjustment is not limited to this. Specifically, the drive of the pump 52 and the opening degree of the valve 54 may be adjusted based on a ratio of the ink concentration after the injection of the correcting liquid to the first value, a rate of change in the ink concentration before and after the injection of the correcting liquid, or the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-10511 filed Jan. 25, 2018, which is hereby incorporated by reference herein in its entirety.

What is claimed is:

1. A printing apparatus which includes a circulation route configured to supply ink stored in a storage unit to a print head via a supply passage and send back the ink collected from the print head to the storage unit via a collection passage and which performs printing on a print medium by ejecting the ink from the print head, the printing apparatus comprising:

a first detection unit configured to detect a concentration of the ink in the collection passage;

an injection unit configured to inject a correcting liquid capable of correcting the concentration of the ink into a circulated ink flow downstream of a position where the first detection unit detects the concentration in the collection passage;

a control unit configured to obtain an injection amount of the correcting liquid based on the concentration detected by the first detection unit and control the injection unit such that the correcting liquid is injected in the obtained injection amount; and a second detection unit provided in the collection passage and configured to detect the concentration of the ink into which the correcting liquid is injected, wherein the control unit adjusts the injection amount of the correcting liquid by the injection unit based on the concentration detected by the second detection unit and preset first concentration information.

2. The printing apparatus according to claim 1, further comprising an agitation unit provided in the collection passage and configured to agitate the ink into which the correcting liquid is injected.

3. The printing apparatus according to claim 1, further comprising a measurement unit provided in the collection passage and configured to measure a flow amount of the ink, wherein the control unit obtains the injection amount of the correcting liquid in consideration of the flow amount measured by the measurement unit.

4. The printing apparatus according to claim 1, wherein the control unit (a) obtains the injection amount of the correcting liquid when the concentration detected by the first detection unit is outside a predetermined range, and (b) adjusts the injection amount of the correcting liquid when the concentration detected by the second detection unit does not match a median of the predetermined range specified by the first concentration information.

5. The printing apparatus according to claim 1, wherein each of the first detection unit and the second detection unit includes a tubular resonance tube and a vibrator arranged in the resonance tube, obtains a resonance frequency at which the resonance tube resonates with the vibrator when the vibrator is made to vibrate while changing frequency, and detects the concentration based on the resonance frequency.

6. A printing apparatus which includes a circulation route configured to supply ink stored in a storage unit to a print head via a supply passage and send back the ink collected from the print head to the storage unit via a collection passage and which performs printing on a print medium by ejecting the ink from the print head, the printing apparatus comprising:

a first detection unit configured to detect a concentration of the ink in the collection passage;

an injection unit configured to inject a correcting liquid capable of correcting the concentration of the ink into a circulated ink flow downstream of a position where the first detection unit detects the concentration in the collection passage;

a control unit configured to obtain an injection amount of the correcting liquid based on the concentration detected by the first detection unit and control the injection unit such that the correcting liquid is injected in the obtained injection amount; and a second detection unit configured to detect the concentration of the ink in the supply passage, wherein the control unit changes the injection amount of the correcting liquid based on the concentration detected by the second detection unit and preset second concentration information.

7. The printing apparatus according to claim 6, further comprising:

an agitation unit provided in the collection passage and configured to agitate the ink into which the correcting liquid is injected; and a measurement unit provided in the collection passage and configured to measure a flow amount of the ink, wherein the control unit obtains the injection amount of the correcting liquid in consideration of the flow amount measured by the measurement unit.

8. The printing apparatus according to claim 6, wherein the control unit (a) obtains the injection amount of the correcting liquid when the concentration detected by the first detection unit is outside a predetermined range, and (b) changes the injection amount of the correcting liquid when the concentration detected by the second detection unit is outside a range specified by the second concentration information, the range being smaller than the predetermined range and having the same median as the predetermined range.

9. The printing apparatus according to claim 6, wherein the control unit changes the injection amount of the correcting liquid by a certain percentage for a certain time.

10. The printing apparatus according to claim 6, wherein the second detection unit has the same configuration as the first detection unit.

11. A concentration correction method of correcting a concentration of ink in a circulation route configured to supply the ink stored in a storage unit to a print head via a supply passage and send back the ink collected from the print head to the storage unit via a collection passage, the concentration correction method comprising:

a first detection step of detecting the concentration of the ink in the collection passage;

an injection step of obtaining an injection amount of a correcting liquid capable of correcting the concentration of the ink based on the concentration detected in the first detection step and injecting the correcting liquid in the obtained injection amount into a circulated ink flow downstream of a position where the concentration is detected in the first detection step in the collection passage;

a second detection step of detecting the concentration of the ink in the supply passage; and a changing step of changing the injection amount of the correcting liquid based on the concentration detected in the second detection step and preset second concentration information.

12. The concentration correction method according to claim 11, further comprising:

a third detection step of detecting the concentration of the ink into which the correcting liquid is injected in the collection passage; and an adjustment step of adjusting the injection amount of the correcting liquid based on the concentration detected in the third detection step and preset first concentration information.

* * * * *